United States Patent [19]

Wakefield

[11] Patent Number: 4,957,282

[45] Date of Patent: Sep. 18, 1990

[54] GYRO-CYCLE

[76] Inventor: Timothy A. Wakefield, 2294 St. Rt. 286, Williamsburg, Ohio 45176

[21] Appl. No.: 380,503

[22] Filed: Jul. 17, 1989

[51] Int. Cl.[5] ..... A63B 21/00

[52] U.S. Cl. ..... 272/73; 272/128

[58] Field of Search ..... 272/73, 128

[56] References Cited

U.S. PATENT DOCUMENTS

| | | | |
|---|---|---|---|
| 4,377,281 | 3/1983 | Jesernig et al. | 272/128 |
| 4,640,508 | 2/1987 | Escher | 272/128 |
| 4,709,917 | 12/1987 | Yang | 272/73 |

*Primary Examiner*—Stephen R. Crow

*Attorney, Agent, or Firm*—Jerrold J. Litzinger

[57] ABSTRACT

A device for exercising the limbs and torso of the user is disclosed. The device comprises a base, a frame rotatably mounted to the base, a support member rotatably coupled to the frame such that it is rotatable about its longitudinal axis, a flywheel coupled to the support member, and means for rotating the flywheel. As the flywheel rotates, it creates a gyroscopic effect, such that as the operator leans to one side, the precessional torque causes the frame to rotate about the base.

18 Claims, 7 Drawing Sheets

GYRO-CYCLE

BACKGROUND OF THE INVENTION

This invention relates generally to exercise devices and, in particular, to a novel gyroscopic and recreational device which provides a more complete physical workout than can be obtained using a conventional stationary bicycle.

Generally, conventional exercise bicycles are operated by pedalling an adjustable wheel which can be varied to change the resistance, thus controlling the amount of energy expended by the user. This type of device, however, only exercises the leg and feet muscles of the person operating the bicycle. In addition, this type of exercise device has a tendency to become boring and monotonous to operate, which may often lead to lack of interest and initiative on the part of the user.

U.S. Pat. No. 4,709,917 attempts to solve this problem by incorporating a mock road condition simulator to enhance the attention of the user. It also teach the use of a motor for providing a controllable pedalling resistance through a feedback system. This device, however, does not assist in developing other areas of the body.

Other devices have attempted to use gyroscopic forces to assist in developing and strengthening selected muscles of the human body. The gyroscopic effect, or precession, of a rapidly spinning mass is capable of producing a strong torque if the user attempts to move the mass in a way which rotates its spin axis.

U.S. Pat. No. 3,617,056 is directed to a dumbell which utilizes the precessional force generated by two spinning weighted discs to enhance the effect of the exercising movements. This device, however, is used basically for exercising the hands and arms of the user.

U.S. Pat. No. 4,703,928 is directed to a gyroscopic exercising device which utilizes a housing containing a spinning mass which forms the rotor of a motor for spinning the mass. The spin axis of the mass is perpendicular to the upper and lower surfaces of the housing. A foot plate, mounted for rotation about two mutually orthogonal axes, is mounted such that rotational movement of the foot is opposed by the gyroscopic effect of the spinning mass, producing an isometric exercise effect. Although this device can be used on any limb of the body or the torso, it does not permit several muscle groups of the body to be exercised simultaneously.

SUMMARY OF THE INVENTION

It is therefore an object of the present invention to provide an exercise device which provides stimulation to several muscle groups of the body simultaneously while avoiding the monotony of a conventional stationary exercise device.

It is also an object of the present invention to provide a stationary exercise bicycle which uses gyroscopic forces to enhance the total quality of exercise for developing the body of the user.

It is a further object of the present invention to provide an exercise apparatus which is manually powered and adjustable to fit the needs and desires of a wide range of persons.

These and other objectives are accomplished in the present instance by an apparatus for exercising the torso and limbs of the body which consists of a base, a frame which is rotatable about the base, a support member which is coupled to the frame and is rotatable about its longitudinal axis, a flywheel which rotates in a plane perpendicular to the longitudinal axis of the support member, and a mechanism operated by the feet of the user to rotate the flywheel. As the user pedals the operating mechanism, the flywheel rotates. If the user leans to one side or the other as the flywheel is rotating, a precessional torque is generated, causing rotation of the frame of the apparatus about its base. A wide variety of pedalling, leaning and turning motions can be produced by the creativity of the user.

DETAILED DESCRIPTION OF THE PREFERRED EMBODIMENTS

Figure 1:
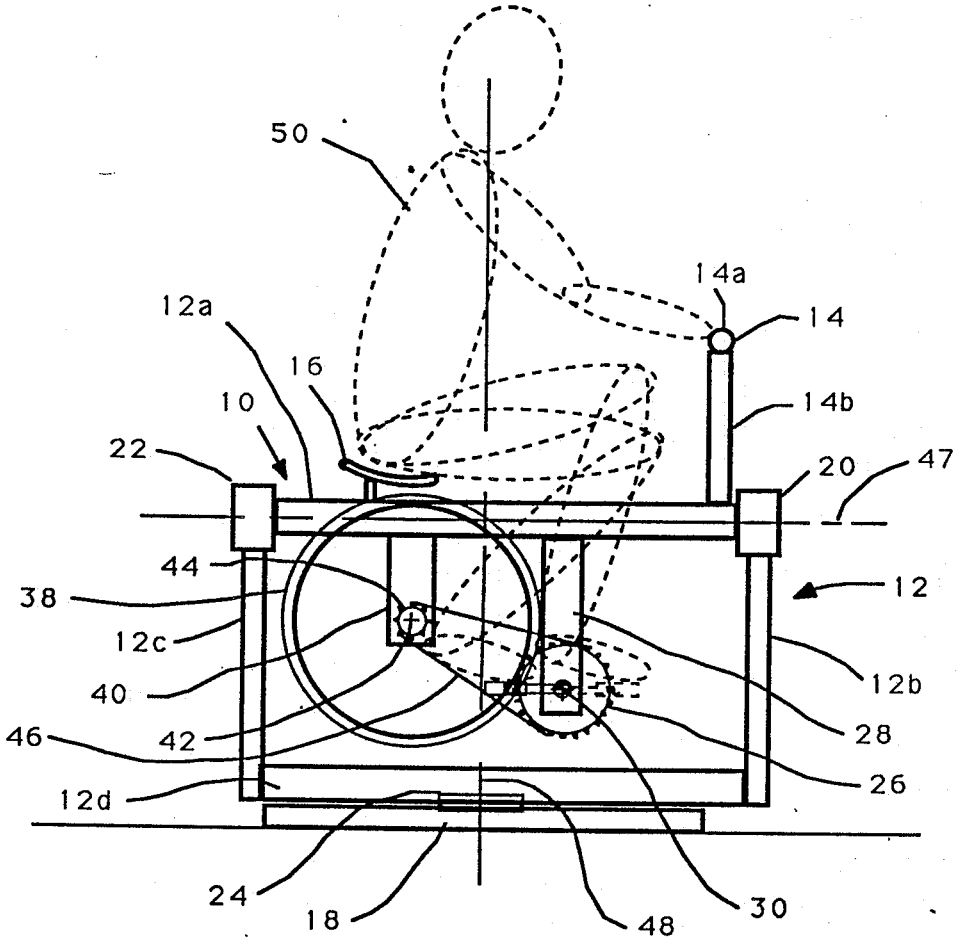
FIG. 1 is a side elevational view of a gyroscopic exercise device in accordance with a first embodiment of the present invention.
Figure 2:
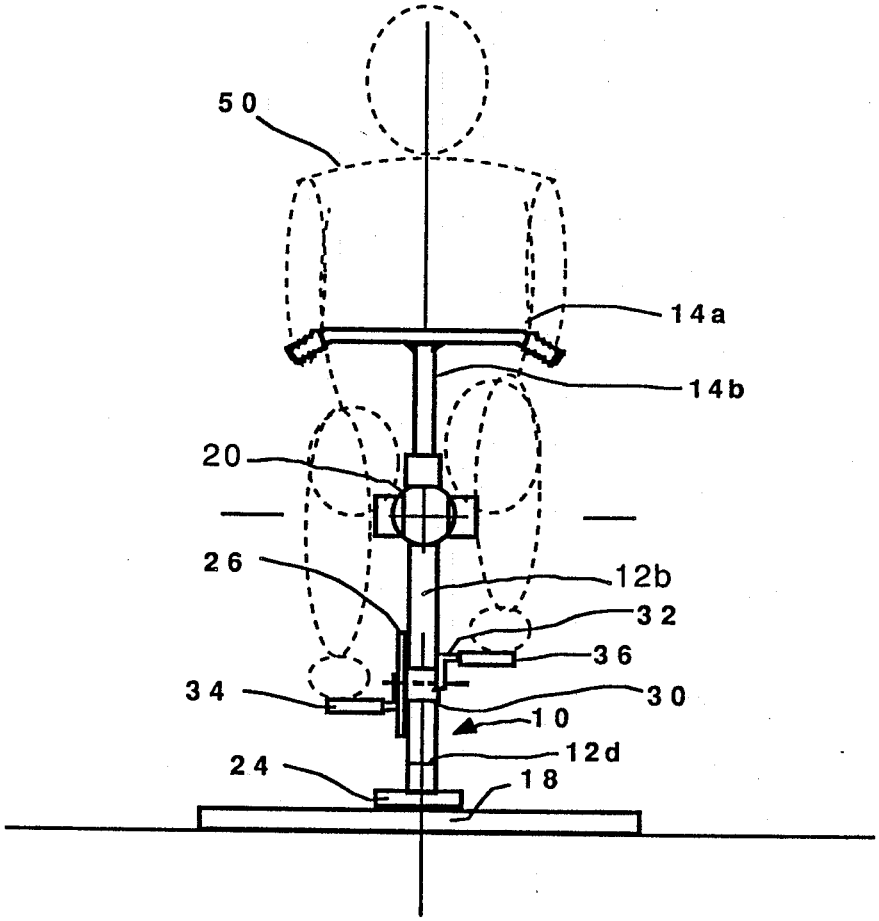
FIG. 2 is a front elevational view of the embodiment shown in FIG. 1.

Referring now to FIGS. 1 and 2, there is shown an embodiment of an exercise bicycle of the present invention, generally indicated at 10. Bicycle 10 consists of a frame indicated at 12, a handlebar set 14, a seat 16, and a base 18. Handlebars **14*a* are rigidly affixed to an upper horizontal support frame member 12*a* by a handlebar shaft 14*b*, at its forward end, and seat 16 is rigidly affixed to frame member 12 toward its rearward end. At the forward end of bicycle 10, frame member 12*a* is rotatably coupled to a front vertical frame member 12*b* by a front bearing 20, while frame member 12*a* is rotatably coupled to a rear vertical frame member 12*c* by a rear bearing 22. Frame members 12*b* and 12*c* are rigidly affixed to bearings 20 and 22 respectively, while said frame members are rigidly affixed at either end of a lower horizontal frame member 12*d*. Frame member 12*d* is rotatably coupled at its central region to base 18 by a bearing 24**.

A drive sprocket 26 is affixed to frame member **12*a* by a sprocket support member 28, with sprocket 26 mounted for rotation within member 28 by a bearing 30. A crankshaft 32 is mounted within bearing 30 with a pair of pedals 34, 36 rotatably mounted at its opposite ends to enable cranking thereof. A flywheel 38 is affixed to frame member 12*a* by a flywheel support member 40, with flywheel 38 rotatably mounted within support member 40 by use of a bearing 42. A flywheel drive sprocket 44 is coupled to one side of bearing 42. A drive chain 46 extends between sprockets 26 and 44 for transmitting rotation of sprocket 26 to sprocket 44 and rotation of sprocket 44 to sprocket 26**.

As can be seen in FIGS. 1 and 2, upper horizontal frame member **12*a* is rotatable about a horizontal axis 47, which axis lies within a plane extending longitudinal through frame member 12*a*. In addition, frame 12 is rotatable about a vertical axis 48, which runs through the center of base 18 and bearing 24. Ideally, axis 48 extends approximately through the center of gravity of a user of bicycle 10, who is shown in phantom at 50**.

In operation, as user 50 operates bicycle 10 via pedals 34 and 36, flywheel 38 rotates as a result of the reaction of crankshaft 32, sprocket 26, drive chain 46, and sprocket 44 at a speed proportional to the pedaling speed. Flywheel 38, because of its mass and speed ratio to the movement of pedals 34 and 36, provides considerable inertial resistance to the pedaling action. Thus, exercise is achieved in accelerating flywheel 38 up to a desired speed.

As user 50 accelerates flywheel 38, if he wishes he is able to lean his body to one side of bicycle 10 or the other. As seat 16 and upper horizontal frame member 12*a* are rotatable about axis 47, flywheel 38 will also rotate about axis 47 as it is rigidly coupled to member 12*a* via support 40. This leaning motion of flywheel 38 causes a gyroscopic torque at right angles to the direction of the lean, which results in a precessional rotation of user 10 and frame 12 about base 18. The reason is that as user 10 and frame 12 leans, a portion of the kinetic energy generated by the rotation of flywheel 38 about its axis is translated into kinetic energy of rotation of user 10 and frame 12 about axis 48 through base 18. When the user returns to his normal upright position, this kinetic energy is returned to flywheel 38, and rotation ceases.

The effect of the present invention is to simultaneously exercise the arms, shoulders, and back of the user by the gyroscopic action of the bicycle, in addition to exercising the legs and feet. The leaning and turning motions require the user to exert force on the handlebars and seat and to maintain balance so as to stay on the seat. These motions and balance require use of the arms and back, thus exercising the upper torso and limbs.

In addition, the device is particularly suited to maintain one's interest because of the wide variation of possible maneuvers. The pedalling, leaning, and turning motions produce a feeling of exhilaration. The gyroscopic torque which causes the device to turn is proportional to the inertia of the flywheel, the rotational speed of the flywheel, and the rate of inclination of the user. Thus, a wide variety of pedalling, leaning, and turning routines are achievable and limited only by the user's innovativeness.

Figure 3:
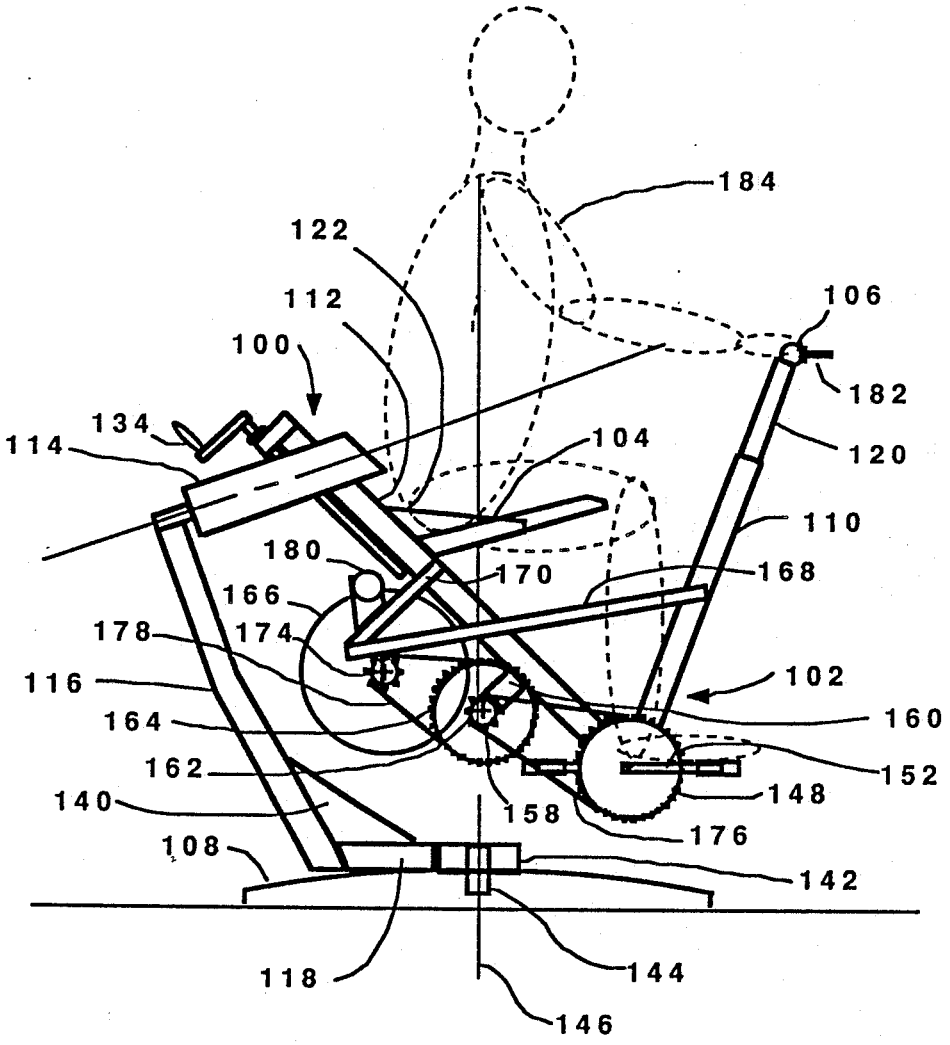
FIG. 3 is a side elevational view of a gyroscopic exercise device according to a second embodiment of the invention.

A second embodiment of the present invention is shown in FIGS. 3–7. Referring now to FIG. 3, an exercise bicycle is generally indicated at 100. Bicycle 100 consists of a frame generally indicated at 102, a seat 104, a handlebar unit 106, and a base 108.

Frame 102 consists of a forward support member 110, a user support member 112, an adjustable housing support 114, a rear support member 116, and a base support member 118. Forward support member 110 is coupled to handlebar unit 106 by an adjustable member 120. Member 120 allows handlebar unit 106 to be positioned so as to accomodate users of different body sizes comfortably. The other end of member 110 is rigidly affixed to user support member 112.

In the central region of support member 112, seat 104 is rigidly affixed to the frame, and may be adjusted relative to member 112 to accomodate different sized users via a seat adjustment member 122. Member 112 is coupled at its upper end to housing support 114. The structure of housing support 114 is shown in greater detail in FIG. 7.

Figure 7:
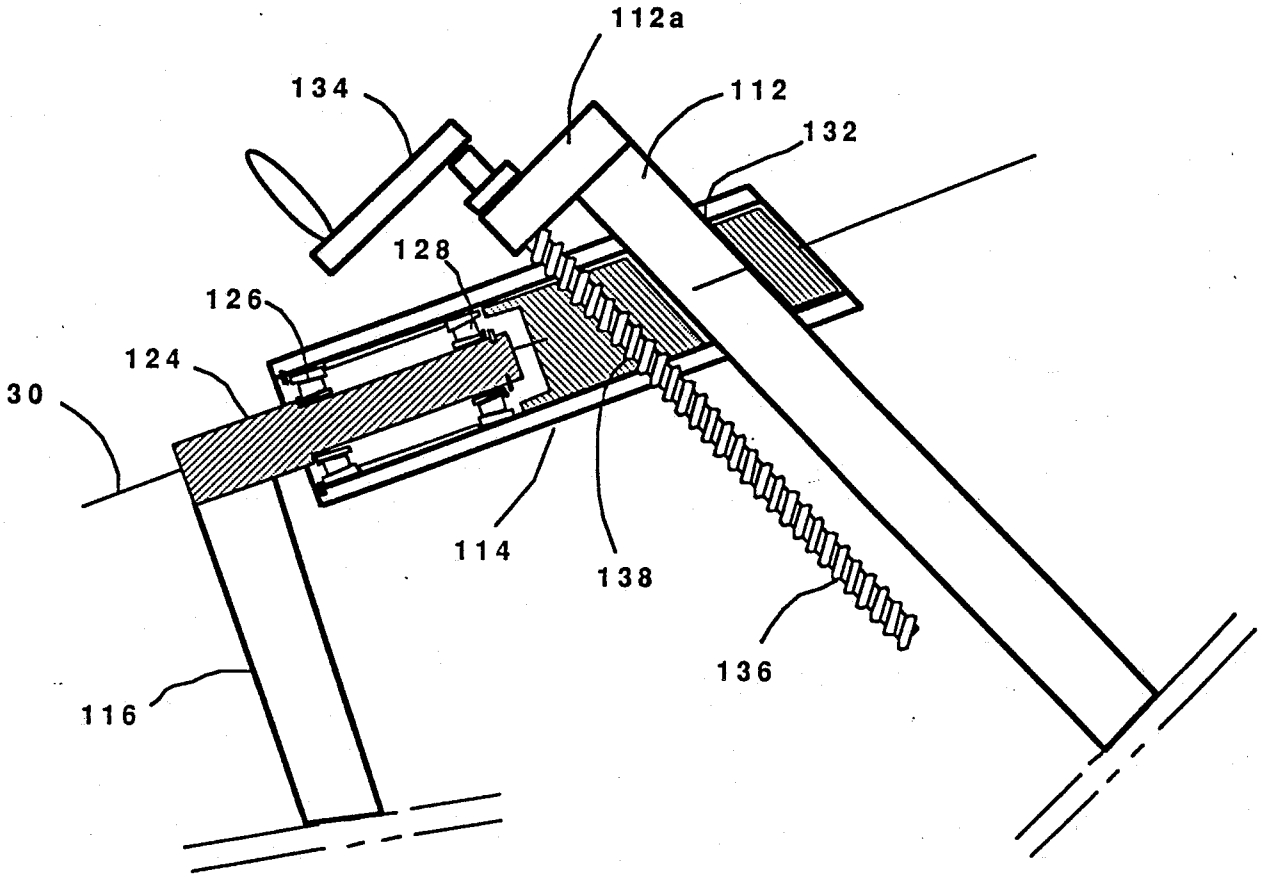
FIG. 7 is a cross-sectional view of the horizontal bearing mount and height adjustment of the embodiment shown in FIG. 3.

Referring now to FIG. 7, housing support 114 is coupled to the upper end of rear support member 116 by a housing support shaft 124. Shaft 124 is rigidly affixed to member 116 at one end, while the other end of shaft 124 is rotatably affixed within housing support 114 by a pair of bearings 126, 128. Bearings 126, 128 allow housing support 114 (along with members 110 and 112) to rotate relative to rear support member 116 about an axis 130 which runs longitudinaly through the center of housing support 114. It should be noted that axis 130 is skewed slightly from the horizontal at approximately 20° . At the opposite end of housing support 114, support member 112 is slideably coupled to support 114 through an aperture 132. Rotatably coupled to a flange 112*a* of support member 112 is an adjustment crank 134. As crank 134 is rotated, it in turn rotates an adjustment screw 136 which is threadably engaged within a corresponding threaded slot 138 in housing support 114. In operation, this structure allows for adjustment of seat 104 to adjust the height of the center of gravity for each user, thus allowing for maximum efficiency of bicycle 100 for any user.

Referring again to FIG. 3, the lower end of rear support member 116 is rigidly affixed to base support member 118 using a support brace 140. Mounted within member 118 is a bearing 142, and base 108 is rotatably coupled to member 118 by a shaft 144 through bearing 142. Thus, frame 102 is free to rotate about a vertical axis 146 through the center of shaft 144.

Figure 6:
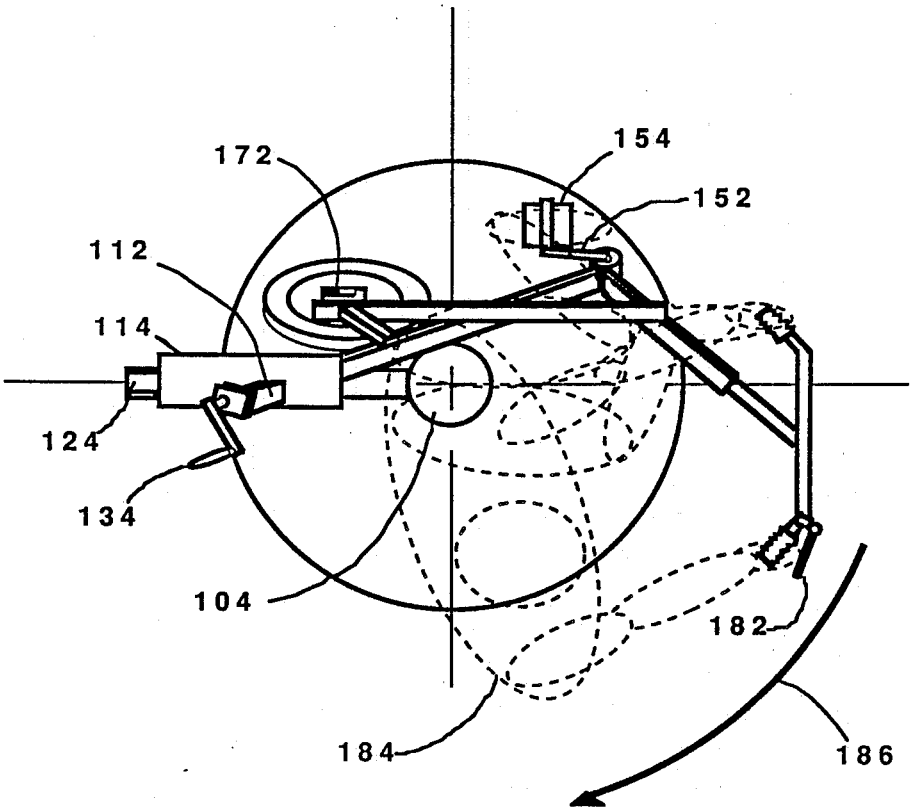
FIG. 6 is a top plan view of the embodiment shown in FIG. 3 showing the device in a leaning mode.

A drive sprocket 148 is rotatably affixed to frame 102 by a sprocket support member 150. A crankshaft 152 is rotatably mounted within sprocket support member 150, while a pair of pedals 154, 156 are mounted at opposite ends of crankshaft 152 to enable cranking thereof. An intermediate shaft 158 is coupled to support member 112 by a sprocket flange 160, with shaft 158 rotatably affixed within the end of flange 160. Rigidly affixed on shaft 158 is a first small intermediate sprocket 162, and a second large intermediate sprocket 164, both of which rotate with shaft 158. Finally, a flywheel 166 is attached to frame 102 by a pair of flywheel support members 168,170. Flywheeel 166 is rotatably attached to support member 168 by a clutch mechanism 172 (FIG. 6). Also affixed to the shaft of mechanism 172 is a flywheel sprocket 174. Clutch mechanism 172 is a one way clutch which allows flywheel 166 to rotate freely or coast whent the user is not operating crankshaft 152.

A first drive chain 176 extends between drive sprocket 148 and small intermediate sprocket 162, while a second drive chain 178 extends between large intermediate sprocket 164 and flywheel sprocket 174. In operation, as the user operates bicycle 100 via pedals 154,156, drive sprocket 162, and also to intermediate sprocket 164 coupled to the same shaft 158. Sprocket 164, in turn, transmits rotation via chain drive 178 to flywheel sprocket 174, thus imparting a rotation to flywheel 166. In this manner, the speed of crankshaft 152 is increased in two stages to flywheel 166.

A drag device 180 is coupled to flywheel support 170, and contacts flywheel 166. Drag device 180 provides a frictional resistance to the rotation of flywheel 166, and is adjustable to vary the force necessary to rotate flywheel 166, thus changing the degree of exercise provided by bicycle 100. In addition, a hand brake 182 is provided for stopping the rotation of flywheel 166. Brake 182, located on handlebar unit 106, is connected to a conventional cable and caliper type friction brake which applies a frictional drag to flywheel 166.

To maximize the effect of the bicycle of the present invention, it is desirable to locate the center of gravity of the user (shown in phantom at 184) along vertical axis 146. This can be accomplished by use of adjustment crank 134, as previously described.

In operation, as user 184 operates bicycle 100 via pedals 154,156, flywheel 166 rotates in a clockwise direction as seen in FIG. 3. As a result of the two stage arrangement, exercise is achieved in accelerating flywheel 166 to a reasonable speed. Additional resistance to pedaling, if desired, can be provided by adjustment of drag device 180.

Figure 4:
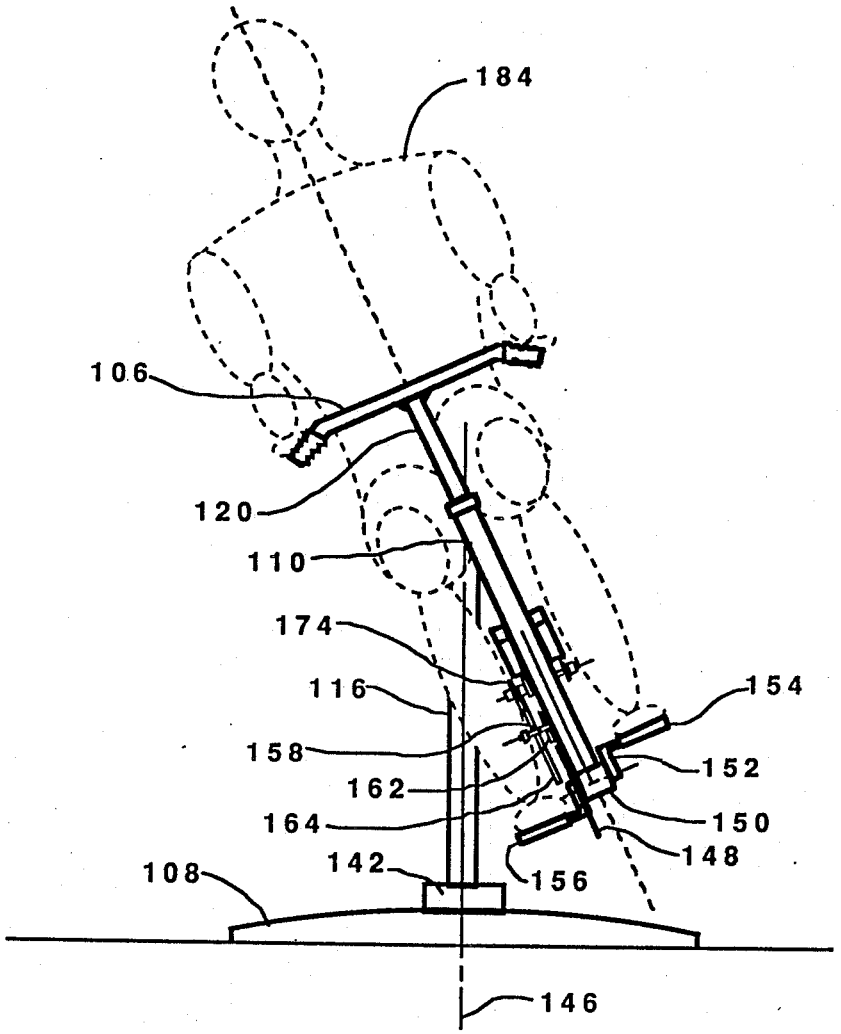
FIG. 4 is a front elevational view of the embodiments shown in FIG. 3 showing the device in a leaning mode.
Figure 5:
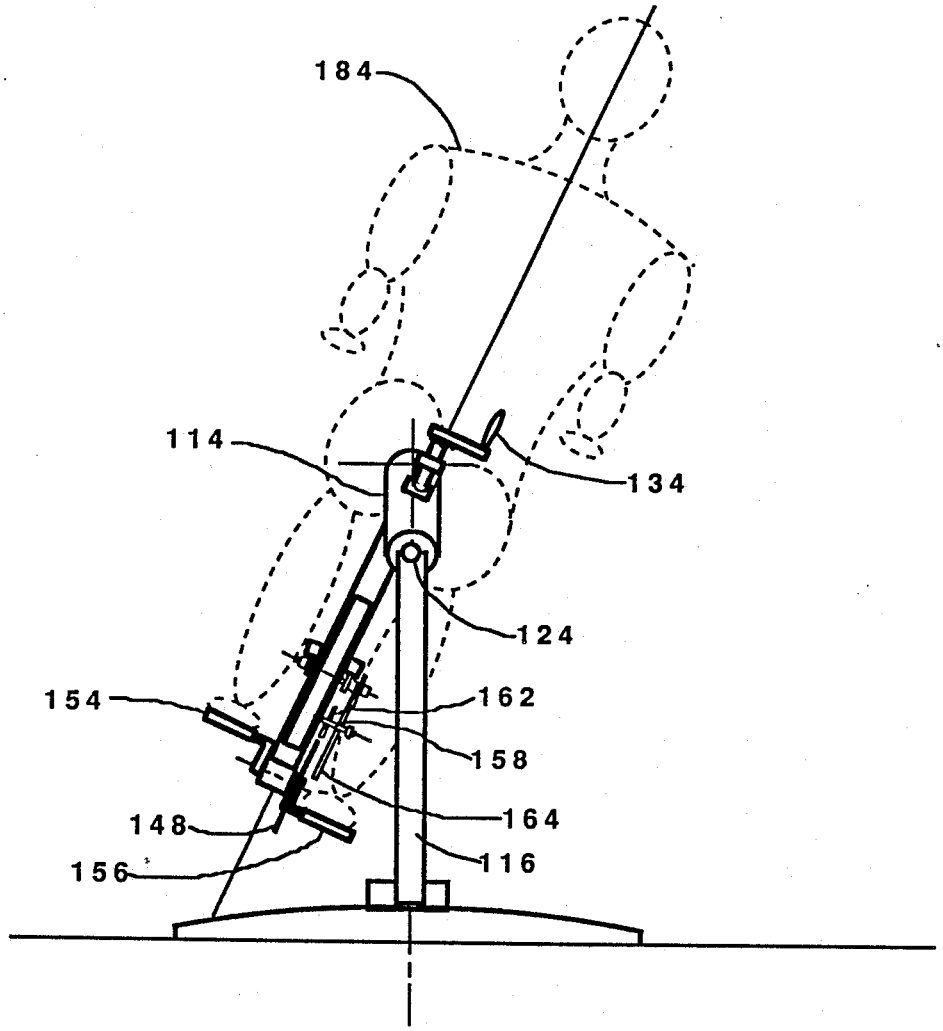
FIG. 5 is a rear elevational view of the embodiment shown in FIG. 3 showing the device in a leaning mode.

FIGS. 4,5, and 6 more clearly illustrate the gyroscopic effect of the present invention. Referring to FIGS. 4 and 5, user 184 leans his body to the right by shifting his weight and exerting force on handlebar unit 106. This action causes frame 102, and flywheel 166, to tilt, generating a gyroscopic torque at right angles to the direction of the lean, resulting in a clockwise precessional rotation of bicycle 100, as shown by arrow 186 in FIG. 6. If user 184 leans to the left, the precessional rotation would be counterclockwise.

While this invention has been shown and described in terms of several preferred embodiments thereof, it will be understood that this invention is not limited to any particular embodiment and that many changes and modifications may be made without departing from the true spirit and scope of the invention as defined in the appended claims.

What is claimed is:

1. An apparatus for exercising the limbs and torso of a user by resisting precessional torque generated by the apparatus, comprising:

a base;

a frame, rotatably coupled to said base for rotation about said base;

a support member for supporting a user, rotatably coupled to said frame for rotation about the longitudinal axis of said support member;

a mass, affixed to said support member, capable of rotation about a spin axis;

and crankshaft means operated by said user affixed to said support member, for rotating said mass, whereby any rotation of said support member causes rotation of said frame about said base due to the precessional torque generated by said rotating mass.

2. The apparatus of claim 1, further comprising a seat, affixed to said support member, for supporting said user.

3. The apparatus of claim 2, whereby said seat is adjustable with respect to said support member to accommodate users of different body sizes.

4. The apparatus of claim 1, wherein said spin axis of said mass is perpendicular to said longitudinal axis of said support member.

5. The apparatus of claim 1, wherein said means for rotating said mass comprises a support flange, rigidly affixed to said support member;

said crankshaft means is rotatably affixed to said support flange; and drive means for mechanically coupling said crankshaft means to said mass to enable rotation thereof.

6. The apparatus of claim 1, further comprising a handlebar unit, affixed to said support member, for supporting the hands of said user while operating said apparatus.

7. The apparatus of claim 6, wherein said handlebar unit is adjustable with respect to said support member to accomodate users of different sizes.

8. An exercise device comprising:

a base;

frame means, rotatably coupled to said base for rotation about said base;

a housing rigidly affixed to said frame means;

support means, rotatably coupled to said housing for rotation about the longitudinal axis of said support means, for supporting a user; flywheel means, affixed to said support means, capable of rotation about an axis perpendicular to said longitudinal axis of said support means;

and crankshaft means operated by said user affixed to said support means, for rotating said flywheel means;

whereby rotation of said support means about its longitudinal axis during rotation of said flywheel means causes rotation of said frame means about said base.

9. The device of claim 8, whereby rotation of said support means in a clockwise direction as viewed from said housing causes a clockwise rotation of said frame means about said base.

10. The device of claim 8, whereby rotation of said support means in a counterclockwise direction as viewed from said housing causes a counterclockwise rotation of said frame means about said base.

11. The device of claim 8, further comprising adjustment means, located within said housing, for adjusting the position of said support means with respect to said frame means.

12. The device of claim 8, wherein said flywheel rotating means further comprises;

said crankshaft means is rotatably coupled to said support means;

a drive sprocket, affixed for rotation with said crankshaft means;

a first intermediate sprocket, rotatably coupled to said support means;

a second intermediate sprocket affixed for rotation with said first intermediate sprocket;

a flywheel sprocket, affixed for rotation with said flywheel means;

a first drive chain, mechanically coupling said drive sprocket with said first intermediate sprocket;

and a second drive chain, mechanically coupling said second intermediate sprocket with said flywheel sprocket, whereby rotation of said crankshaft means causes rotation of said flywheel means.

13. The device of claim 8, further comprising drag means for providing resistance to the rotation of said flywheel means.

14. The device of claim 11, whereby said adjustment means is used to position the center of gravity of said user along a vertical axis through the center of said base.

15. The device of claim 8, wherein said support means futher includes means for supporting the hands of said user while operating said device.

16. The device of claim 8, wherein the angle between said longitudinal axis of said support means and the horizontal axis is approximately 20°.

17. The device of claim 8, further comprising a handlebar unit, affixed to said support means, for supporting the hands of a user.

18. The device of claim 17, wherein said handlebar unit is adjustable with respect to said support means to accommodate users of different body sizes.

* * * * *